US005234061A

United States Patent [19]

Hesse

[11] Patent Number: 5,234,061

[45] Date of Patent: Aug. 10, 1993

[54] PERCUSSION MACHINE, FOR EXAMPLE SELF-PROPELLED RAM BORING MACHINE

[75] Inventor: Alfons Hesse, Lennestadt, Fed. Rep. of Germany

[73] Assignee: Tracto-Technik Paul Schmidt Spezialmaschinen KG, Lennestadt, Fed. Rep. of Germany

[21] Appl. No.: 850,416

[22] Filed: Mar. 12, 1992

[30] Foreign Application Priority Data

Mar. 15, 1991 [DE] Fed. Rep. of Germany ..... 4108412
May 3, 1991 [DE] Fed. Rep. of Germany ..... 4114593

[51] Int. Cl.[5] ..... E21B 7/26
[52] U.S. Cl. ..... 175/19; 173/136
[58] Field of Search ..... 175/19, 22, 99, 219; 173/91, 135, 136

[56] References Cited

U.S. PATENT DOCUMENTS 1,264,318 4/1918 McGrath ..... 173/136
1,665,046 10/1924 Tucker ..... 173/136
2,110,331 7/1933 Gartin ..... 173/135
2,403,582 7/1946 Caudill ..... 173/136
4,070,948 1/1978 Tkach et al. ..... 173/136
4,078,619 3/1978 Sudnishnikov et al. ..... 175/19
4,708,211 11/1987 Shemyakin et al. ..... 175/19
4,840,237 6/1989 Roemer ..... 175/19
5,056,608 10/1991 Hemmings ..... 175/19

*Primary Examiner*—Ramon S. Britts
*Assistant Examiner*—Frank S. Tsay
*Attorney, Agent, or Firm*—Anderson Kill Olick & Oshinsky

[57] ABSTRACT

In a percussion mach in particular a self-propelled ram boring machine, with a percussion piston which is axially movable in the machine housing, has a hollow piston rod and is acted on by a pressure medium via a supply hose connected to the rear end of the housing, a piston rod bore communicates with the pressure medium supply when the percussion piston is in the front end position and communicates with a discharge opening when the percussion piston is in the rear end position.

13 Claims, 6 Drawing Sheets

PERCUSSION MACHINE, FOR EXAMPLE SELF-PROPELLED RAM BORING MACHINE

TECHNICAL FIELD OF THE INVENTION

The invention relates to a percussion machine, particularly but not exclusively a self-propelled ram boring machine, having a percussion piston with a hollow piston rod, which piston is axially movable in the housing of the machine and is acted on by a pressure medium via a supply hose connected to the rear end of the housing.

BACKGROUND OF THE INVENTION AND PRIOR ART

To lay supply lines, such as water pipes or cables beneath streets or embankments or other building structures or obstacles, without digging trenches, it is known to drive a boring rod into the ground by means of a percussion machine arranged in an excavation and to statically push the boring rod and set it in rotation by means of a pneumatically or hydraulically driven drive unit likewise arranged in the excavation on a mounting. Furthermore, instead of allowing the percussion machine to act on the rear end of the boring rod, it is known to arrange at the tip of the boring rod a ram boring machine having a percussion piston which can reciprocate in a tubular housing of the machine. In both cases the generally necessary starting excavation is required to be of a minimum length which corresponds to the length of the boring rod part to be driven-in, together with the length of the percussion machine. Owing to the often very restricted availability of space in the (starting) excavations it is still desirable, even when making bore holes in the earth by displacement of the earth, that the ram boring machines used for this purpose, which work their way into the earth under the impacts of the percussion piston, have a short overall length.

Both in the case of self-propelled ram boring machines which make bore holes in the earth according to the earth displacement principle and machines which only deliver impacts—which latter, in contrast to the earth displacement machines, need not necessarily be provided with a reversing mechanism for ensuring backward running of the machine—it is known to use for the reciprocating movement of the percussion piston, and for changing the running direction of the ram boring machine, a control mechanism which works on the plunger-piston-principle. This method of construction requires a certain machine length, because a control piston is accommodated by an axial bore in a tubular section of the percussion piston forming an inner cylinder or pressure chamber. The forward and backward movement of the percussion piston, as well as the prevailing running direction of the ram boring machine, can be set, for example, by means of a fixed control sleeve with control openings, which controls the covering of radial control openings located in the percussion piston and which is connected to a bearing tube, and a control sleeve with corresponding control openings which is rotatably mounted in the bearing tube.

In the case of a ram boring machine disclosed in German patent 23 40 751 having a control mechanism for the forward and backward running, a control sleeve is held in both operating positions against a guide ring provided with venting bores, by means of stops. The control sleeve is located on an outer tube and is fixed in position; an inner tube provided with radial openings is rotated. This tube provides that either a front or rear control bush comes fully into play and controls the direction of movement of the piston. For reversal, the rotation locking mechanism must be released by means of a rope or cable. Apart from the plunger-piston-principle, which increases the structural length, with the method of construction of the known ram boring machines only small passages, such as in particular minimal annular slots between the piston and the machine housing, are left for the exhaust air that flows to the rear end of the machine, which can result in a back-up of flow and a reduction in the power of the ram boring machine. Finally, the compressed air for providing forward movement of the percussion piston can only act on the inner piston bore surface, namely the inner pressure chamber of the percussion piston.

A compact ram boring machine is known from U.S. Pat. No. 4,070,948. Simply in order to be able to provide the connections for fluid flow between the pressure medium supply and the pressure chambers necessary for reversing the percussion piston and for switching the direction of running of the ram boring machine, the compact construction necessarily requires a multi-stepped percussion piston and/or the bore of the housing to be turned out. The pressure medium supplied from the rear end of the housing acts, in accordance with the plunger-piston-principle, on the front face of the smallest diameter step of the percussion piston, which step part is piston rod like with an axial air bore and enters the end screw fitting, in which a pressure chamber bounded forwardly by the front face forms upon the forward movement of the percussion piston. When striking the front face, the pressure medium thus also simultaneously enters the axial, restricted-length air bore, the end of which is provided with at least one radial distributor bore which leads the pressure medium into the pressure chamber located in front of the percussion piston. Aside from the great technical/manufacturing effort involved—no smooth housing bore; numerous piston bores or passages—only a small area of the percussion piston, namely the smallest step section, can be acted on by the pressure medium in this known machine also.

OBJECT OF THE INVENTION

It is an object of the invention to provide a compact percussion machine, for example a self-propelled ram boring machine, that is simple to manufacture and enables an improved supply (supply and discharge) of pressure medium.

SUMMARY OF THE INVENTION

In accordance with the present invention, this object is achieved in that a piston rod bore of the piston rod communicates with the pressure medium supply when the percussion piston is in the forward end position and communicates with a discharge opening when the percussion piston is in the rear end position. The plunger-piston-principle used in the known machines is completely avoided, and the percussion piston can be acted on by pressure over a large area, namely over its outer annular surface, whereby the hose coupling can advantageously be arranged eccentrically. The piston rod can be formed so that it penetrates the rear end of the housing. To move the piston forwards, in accordance with the invention the annular surface between the piston rod and the machine housing can advantageously be acted on. Furthermore the length of the percussion machine can be shortened, for the same stroke, the same piston weight and the same number of impacts, i.e. a short method of construction is possible. Finally, neither a cylinder chamber in the percussion piston nor a housing with a stepped, difficult to manufacture, housing bore is needed; the housing bore may be smooth.

If the piston rod is guided in a housing end screw fitting and the discharge opening is an annular chamber in the end screw fitting then the end screw fitting that is necessarily present in any machine can be used in accordance with the invention for changing over the direction of travel of the percussion machine or for reversing the movement of the percussion piston.

The percussion piston may have an axial passage that extends from its front end into the piston rod with at least one transverse bore arranged in the piston rod, which transverse bore can advantageously communicate with a cylinder chamber enclosed between the end screw fitting and the percussion piston. The piston rod, having the axial passage and the transverse bore for the supply and discharge of air, can be made substantially smaller in diameter than the percussion piston so that there is provided a correspondingly larger annular chamber, which is acted on by pressure for moving the piston, namely between the piston rod of the percussion piston and the housing wall, via which annular chamber the air can enter without flow back-up into the transverse bore and the axial passage and flow to the front of the piston. Discharge air can also leave unhindered as the annular chamber in the end screw fitting, into which the piston rod enters increasingly deeply with the return stroke of the percussion piston, can be made sufficiently large, since the piston rod does not need to be guided in this part of the end screw fitting.

The piston rod can be guided in a control bush arranged in the end screw fitting. By means of the control bush the supply and discharge of air can be controlled so that a change over from the forward running direction to the backward running direction of the percussion machine takes place, whereby in particular a ram boring machine changed over to backward running in the earth bore can automatically travel back to the starting point, i.e. the starting excavation.

If there is arranged at the rear end of the housing a distributor cap that has a blind bore with at least one distributor bore which communicates with a flow passage leading into the cylinder chamber located behind the percussion piston and which is provided with at least one discharge bore, the percussion piston can be acted on over a large surface even if the pressure medium is supplied centrally into the then centrally extending blind bore. This is because the distributor bore of the distributor cap formed here quasi as the end screw fitting guides the pressure medium that flows in via the blind bore—which is connected to the supply hose—into the radially external flow passage, which supplies the pressure medium to the large annular surface of the percussion piston.

The distributor cap can be arranged in the machine housing so as to be fixed against rotation, e.g. it can be secured there by means of ring segments. This not only ensures a constant secure arrangement or connection between distributor bore and flow passage, but allows simple mounting of the distributor cap.

With a control bush arranged in an elastic block a particularly impact absorbing bearing can be obtained.

In another solution for reversing the direction of running of the percussion machine, the piston rod advantageously has a continuous axial passage into which a plug-like insert engages from the front end of the piston rod. Depending on the position of the insert, that preferably has a hollow cylindrical control head with a transverse bore, one of—in this case—two transverse bores in the piston rod is blocked by the control head whilst the other transverse bore stands in free flow connection with the transverse bore of the insert. As with the control bush arranged in the end screw fitting, the position of the insert engaging in the piston rod or the position of the control head is so set that for the forward running of the percussion or ram boring machine the pressure medium can only reach the space in front of the percussion piston via the transverse bore and the axial passage very much later than when backward running is set.

If the control bush and the insert are axially displaceable the backward or forward running of the machine can be achieved by means of a control bush or an insert engaging to a greater or lesser extent into the end screw fitting or the piston rod.

The control bush and the insert can advantageously be adjusted by screwing them into the end screw fitting or the piston rod.

BRIEF DESCRIPTION OF THE DRAWINGS

The invention will now explained in more detail with reference to exemplary embodiments shown in the drawings, in which.

DETAILED DESCRIPTION OF PREFERRED EMBODIMENTS OF THE INVENTION

Figure 1:
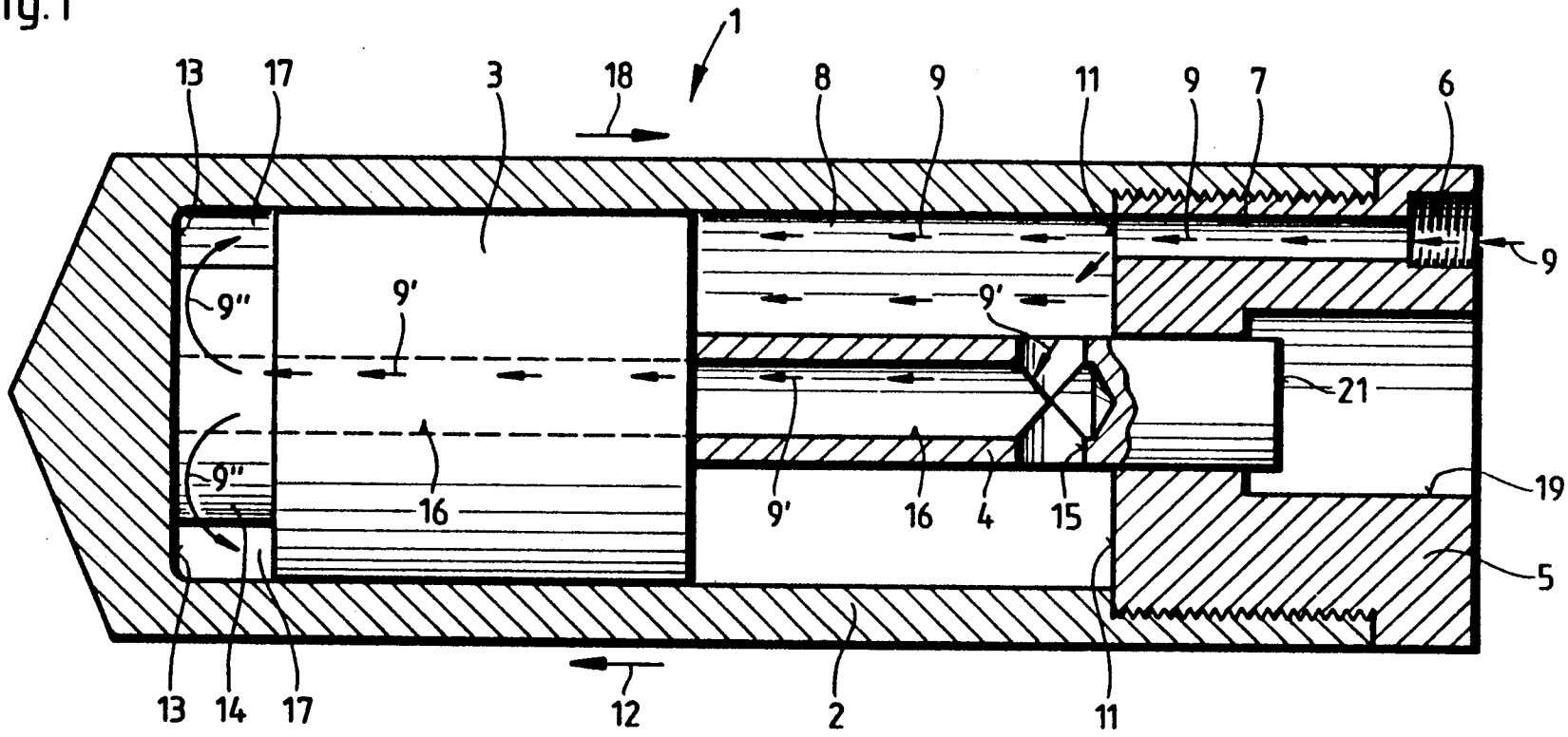
FIG. 1 shows, in longitudinal section and in the forward running disposition, a percussion machine according to the invention having a piston rod guided in an end screw fitting and formed for reversing the direction of movement of a percussion piston.

A percussion machine in the form of a ram boring machine 1 has a reciprocating percussion piston 3 in a hollow, cylindrical housing 2 that is pointed at the front. The percussion piston penetrates with a piston rod 4 an end screw fitting 5 that closes off the rear end of the housing and guides the piston rod 4. The percussion piston 3 is supplied with compressed air that flows into the cylinder chamber 8 located behind the percussion piston 3, from a compressed air source (not shown) via a pressure hose (not shown) that is connected to an eccentrically arranged hose coupling 6 on the end screw fitting 5, and a flow passage 7 arranged to follow after the hose coupling, as indicated by the flow arrows 9 in FIG. 1. The pressure medium thus acts on the outer, large annular surface of the percussion piston 3. Because of the pressure which builds up in the cylinder chamber 8 and acts on the outer annular surface of the percussion piston 3, the percussion piston 3 is moved forward, in the arrowed direction 12, out of its rear end position (not shown in FIG. 1) in which it abuts the stop 11 defined by the front end face of the end screw fitting 5, until it takes up the front end position shown in FIG. 1. This position is defined by the front stop 13 on the housing on which a piston extension 14 of the percussion piston 3 impacts.

An axial passage 16, which extends through the piston extension 14 and the percussion piston 3 into the piston rod 4 from which it opens into a transverse bore 15, delivers compressed air into a cylinder chamber 17 located in front of the percussion piston 3, as indicated by the arrows 9'. Here the compressed air is distributed, after leaving the piston extension 14, as indicated by the flow arrows 9", and builds up a pressure that returns the percussion piston 3 to its rear stroke end position in the arrowed direction 18. The free end 21 of the piston rod 4 projecting into an annular chamber 19 in the end screw fitting 5 enters increasingly further into the annular chamber 19 with the return movement of the percussion piston 3 in the arrowed direction 18, and the compressed air flowing out of the annular space 17 via the axial passage 16, against the direction of the arrows 9", can then escape rearwardly without hindrance, as soon as the transverse bore 15 stands in free flow connection with the annular chamber 19.

When the percussion piston 3 is in the rear end position the piston rod 4 projects so far from the section of the end screw fitting 5 which guides the piston rod 4 that the transverse bore 15 can communicate unhindered with the annular chamber 19. Upon forward movement in the arrowed direction 12 the rear piston surface of the percussion piston 3 is initially acted on with full force by the compressed air flowing in via the passage 7 into the rear cylinder chamber 8 and only when the transverse bore 15 again enters the region of the cylinder chamber 8, which becomes increasingly larger with the forward movement, can air reach the cylinder chamber 17 in front of the percussion piston via the transverse bore 15 and the axial passage 16 as indicated by the arrows 9', 9" and there form a pressure cushion to return the percussion piston 3. The cycle of events described above is repeated with each reciprocal movement of the percussion piston 3.

The percussion and ram boring machines 1 shown in FIGS. 2 to 6 do not differ in basic construction, or operations for reversing the percussion piston, from the above-described percussion machine of FIG. 1, so that similar parts—even if they are not mentioned again in the following description of the embodiments shown in FIGS. 2 to 6—are provided with the same reference numerals. The machines according to FIGS. 2 to 5 do, however, have the capability for automatically reversing the running direction of the machine 1, in addition to reversing the movement of the percussion piston. When the machine is running backwards the full impact power of the percussion piston 3 is no longer applied to the front stop 13 but to the rear stop 11 defined by the end screw fitting 5.

Figure 2:
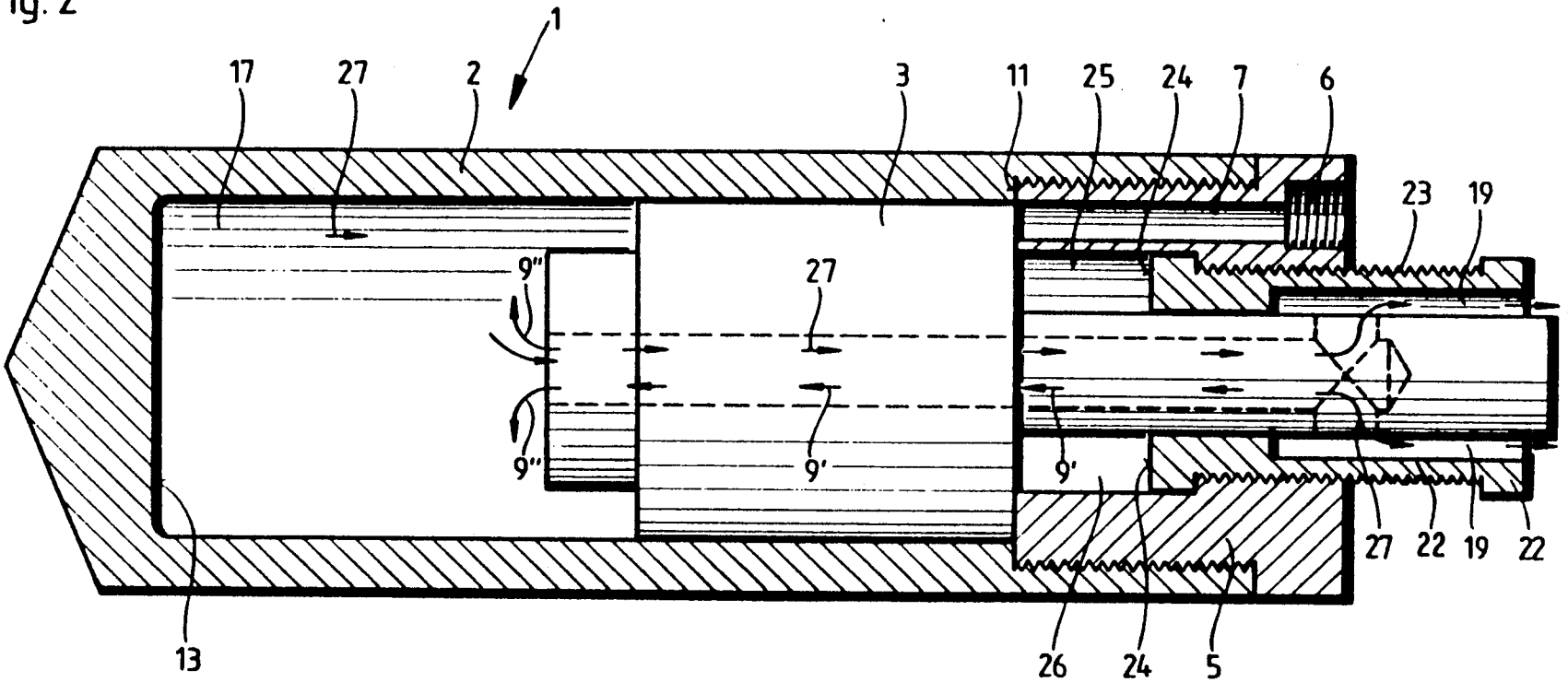
FIG. 2 shows, in longitudinal section, a percussion machine as shown in FIG. 1 with a control bush arranged in the end screw fitting for receiving the piston rod and for reversing the running direction of the percussion machine, the control bush being in a disposition for backward running of the percussion machine.
Figure 3:
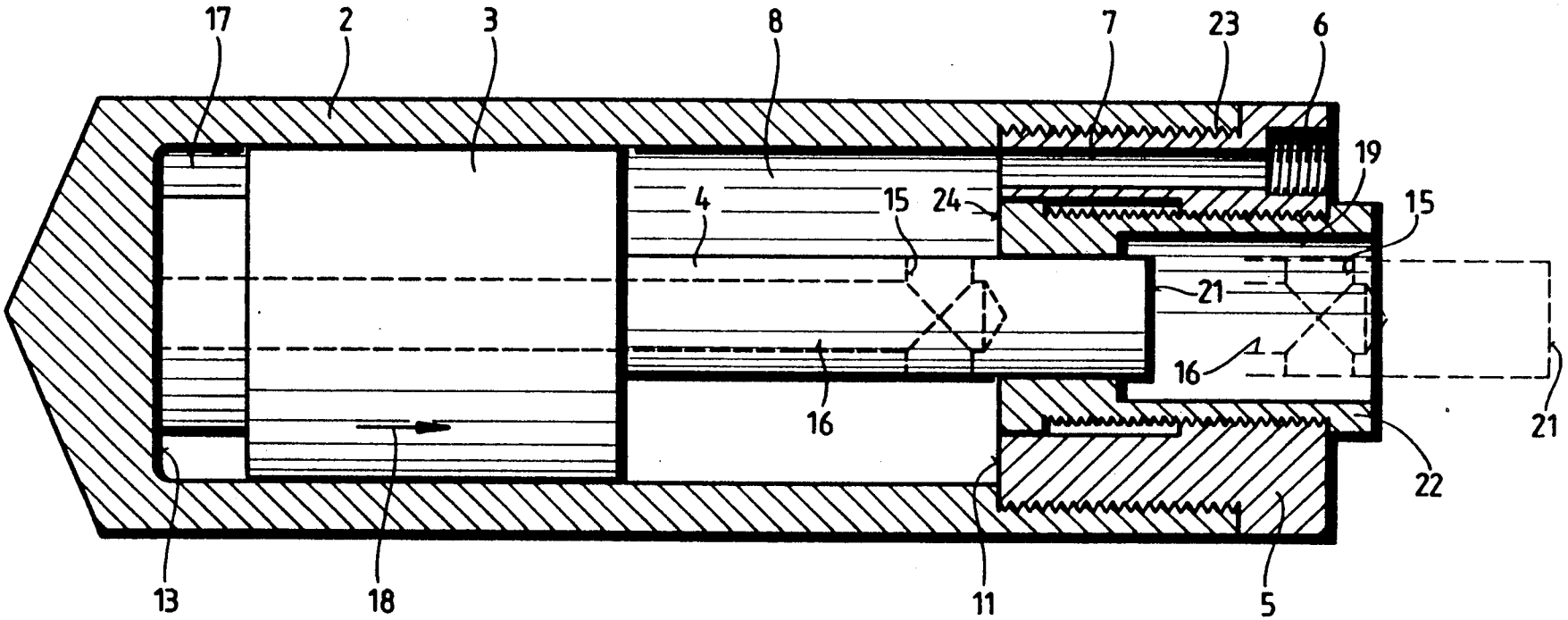
FIG. 3 shows the percussion machine of FIG. 2 with the control bush set for forward running.

For this purpose, in the embodiment shown in FIGS. 2 and 3, a control bush 22 provided with the annular chamber 19 is screwed into the end screw fitting 5 and receives the piston rod 4 in a guiding section. The control bush 22 can be displaced axially by means of its thread 23 and can be set in two positions. The position of the control bush 22 for backward running of the ram boring machine 1—for moving out of an earth bore—is shown in FIG. 2 and the position for forward running of the ram boring machine 1 is shown in FIG. 3. In the forward running control disposition, shown in FIG. 3, the control bush 22 engages so far into the end screw fitting 5 that its front end face 24 stops flush with the front face of the end screw fitting 5 defining the rear stop 11 for the percussion piston 3 and thus likewise serves as a stop for the percussion piston 3. However, in the control disposition for backward running of the ram boring machine 1, as shown in FIG. 2, the control bush is screwed out towards the rear to project from the end screw fitting 5.

The radial free space 26, which corresponds to the thickness of the jacket of the control bush 22 and lies between the piston rod 4 and the wall 25 of the bore of the end screw fitting 5 receiving the control bush 22, is available to the pressure medium flowing into the cylinder chamber 8 located behind the percussion piston 3 when the control bush 22 is in the disposition for switching the ram boring machine 1 to backward running. When the percussion piston 3 moves forward in the arrowed direction 12 the transverse bore 15 and the axial passage 16 in the piston rod 4 thus achieve a very early flow connection with the inflowing compressed air, i.e. on entry into the free space 26. The compressed air can then immediately flow, as indicated by the arrows 9', 9", into the cylinder chamber 17 located in front of the percussion piston 3 and build up the pressure required for providing the impact power needed for the backward running of the ram boring machine 1. When the ram boring machine is running backwards the compressed air flows out of the cylinder chamber 17, as shown by the arrows 27 in FIG. 2, to the rear and leaves via the transverse bore 15 which, in the rear end stroke position shown, lies completely free in the annular chamber 19 of the control bush 22, whereby a large discharge cross-section is afforded.

With the control bush 22 set for the forward running direction of the ram boring machine 1, as shown in FIG. 3, the percussion piston 3 must in contrast initially move a greater distance in the forward direction 12 out of its rear end position (not shown), corresponding to the greater screw-in length as compared to the backward running control disposition shown in FIG. 2. Only when the piston rod 4 has been displaced from its disposition, as shown by broken lines in FIG. 3, when the percussion piston 3 is in its rear end position, and moved so far forward that the transverse bore 15 is in flow connection with the cylinder chamber 8 can compressed air flow via the transverse bore 15 and the axial passage 16 into the cylinder chamber 17 located in front of the percussion piston 3. Although this allows the build up of pressure in the cylinder chamber 17 for moving the percussion piston 3 back into the rear end position shown in FIG. 2, the pressure is not however sufficient to change the running direction of the ram boring machine 1. In the set disposition of the control bush 22 shown in FIG. 3 the ram boring machine 1 thus always runs forwards; for the ram boring machine 1 to run backwards the control bush 22 must be moved into the position shown in FIG. 2.

Figure 4:
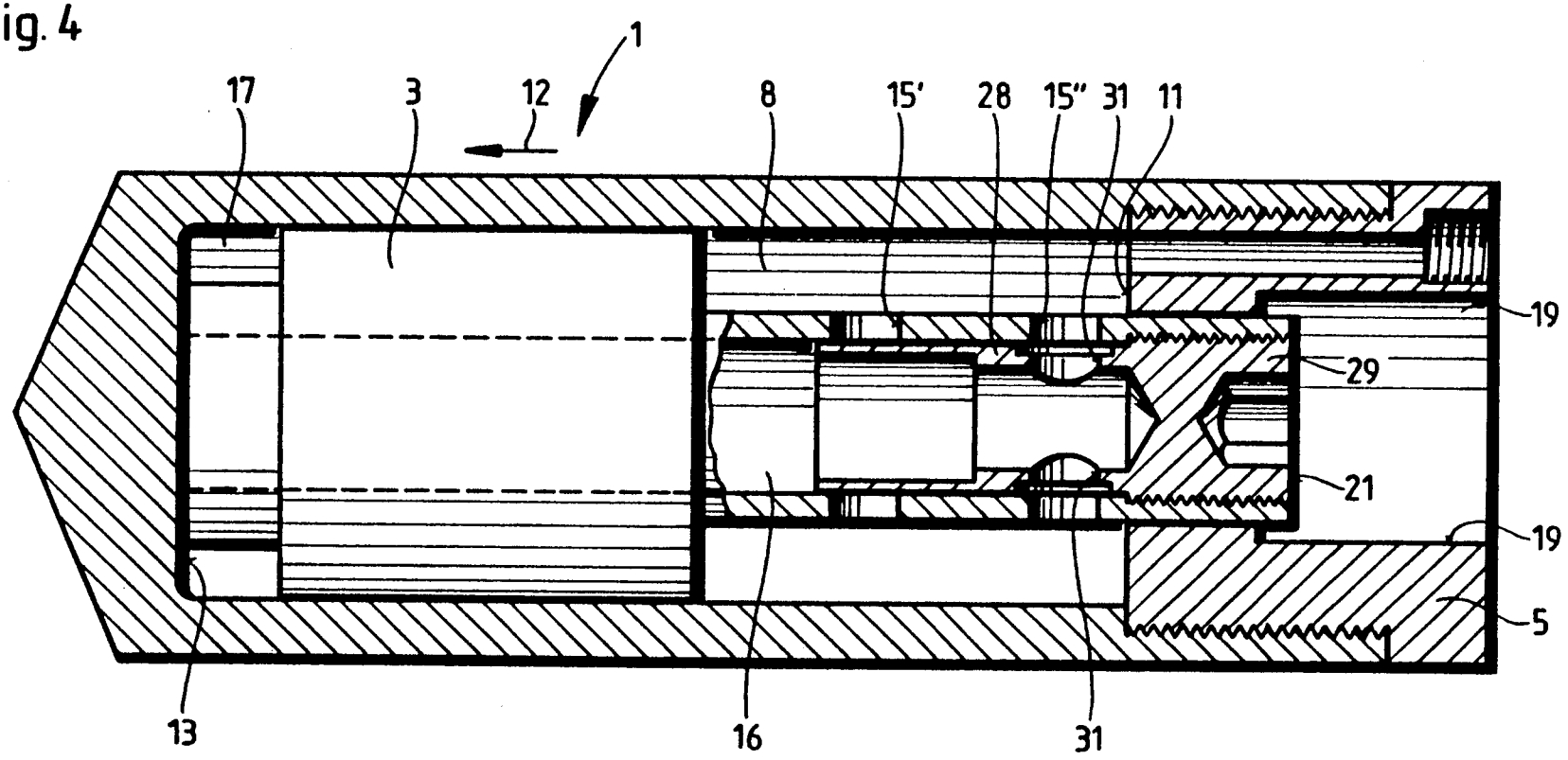
FIG. 4 shows, in longitudinal section, a percussion machine as shown in FIG. 1 with an insert having a hollow cylindrical control head that is screwed into the piston rod, the insert being shown in the disposition for forward running of the percussion machine.
Figure 5:
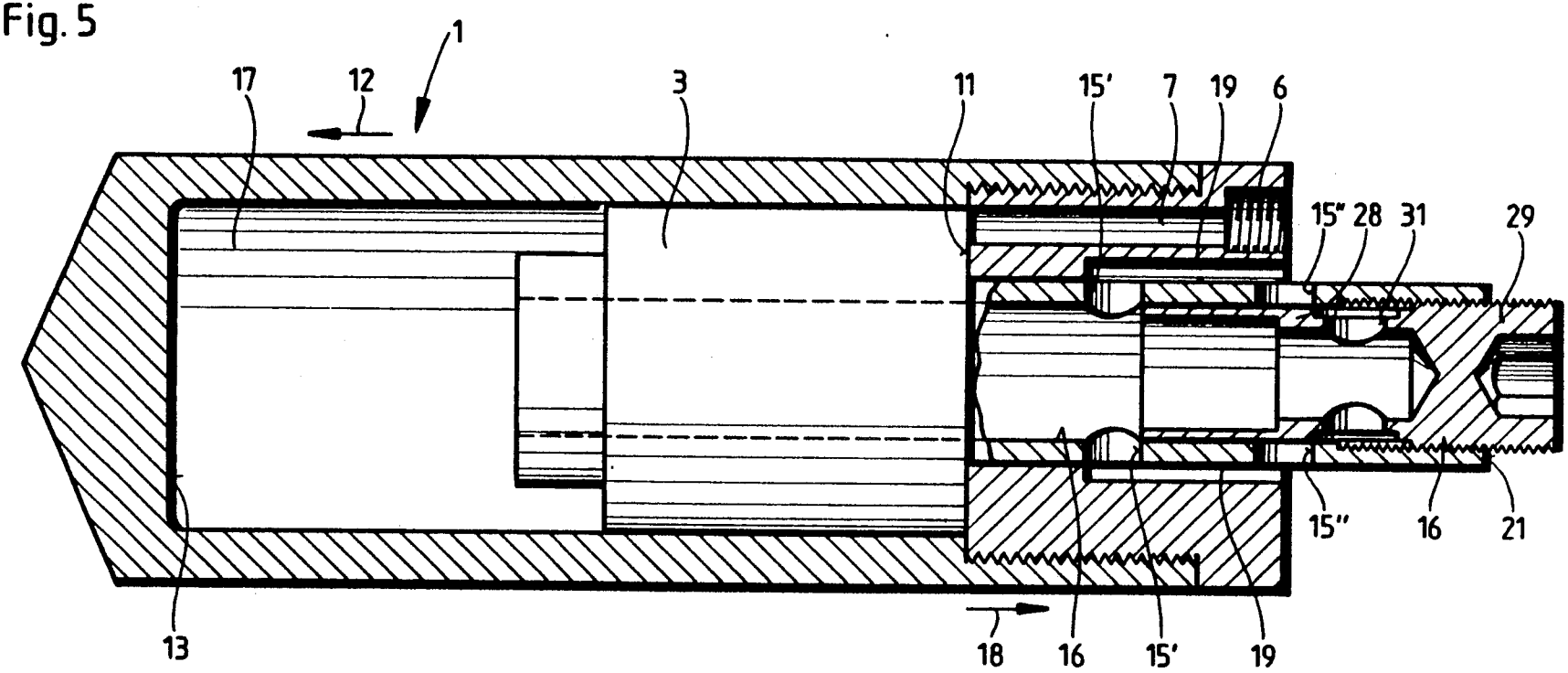
FIG. 5 shows the percussion machine of FIG. 4 with the insert set for backward running of the machine.

In the embodiment of FIGS. 4 and 5 to build up a pressure cushion acting forwardly or rearwardly on the ram boring machine—with higher pressure in either the cylinder chamber 8 located behind the percussion piston 3 or in the cylinder chamber 17 located in front of the percussion piston 3—an insert 29 having a hollow cylindrical control head 28 is screwed into the piston rod 4 to a greater or lesser extent. The insert 29 is provided with a transverse bore 31 in the control head 28. The piston rod 4 of the percussion piston 3 here has a front and a rear transverse bore 15' and 15" respectively. Depending on the extent to which the insert 29 is screwed-in, either the front transverse bore 15' is blocked by the control head 28 of the insert 29, whilst on the other hand the rear transverse bore 15" is aligned with the transverse bore 31 of the insert 29, as is the case in the control setting for forward running of the ram boring machine 1 as shown in FIG. 4, or the insert 29 is screwed out of the piston rod 4 so far that the front transverse bore 15' is free, whilst on the other hand the rear transverse bore 15" is covered by the control head 28, as is the case in the control setting for backward running of the ram boring machine 1 as shown in FIG. 5.

As a consequence of the disposition of the insert 29 as shown in FIG. 4, which sets the forward running of the ram boring machine 1, upon movement of the percussion piston 3 in the arrowed direction 12 a flow connection to the cylinder chamber 17 located in front of the percussion piston 3 is established very late, namely when the transverse bore 31 of the insert 29 communicating with the rear transverse bore 15" of the piston rod 4 leaves the end screw fitting 5 and enters the cylinder chamber 8 located behind the percussion piston 3. To enable enough pressure to accumulate in the cylinder chamber 17 located in front of the percussion piston 3 for backward running of the ram boring machine 1, the front transverse bore 15' of the piston rod 4 is free in the backward running setting shown in FIG. 5, so that when the percussion piston 3 is acted on by the compressed air supplied via the passage 7 and the percussion piston 3 is thereby caused to move forwards in the direction of the arrow 12, the front transverse bore 15' very soon enters the cylinder chamber 8 located behind the percussion piston 3. The pressure medium can then flow via the transverse bore 15' and the axial passage 16 into the cylinder chamber 17 and build up a pressure there sufficient to urge the percussion piston 3 with great force in the arrowed direction 18, i.e. to act rearwardly, so that the percussion piston 3 striking the rear stop 11 moves the ram boring machine 1 as a whole backwards.

Figure 6:
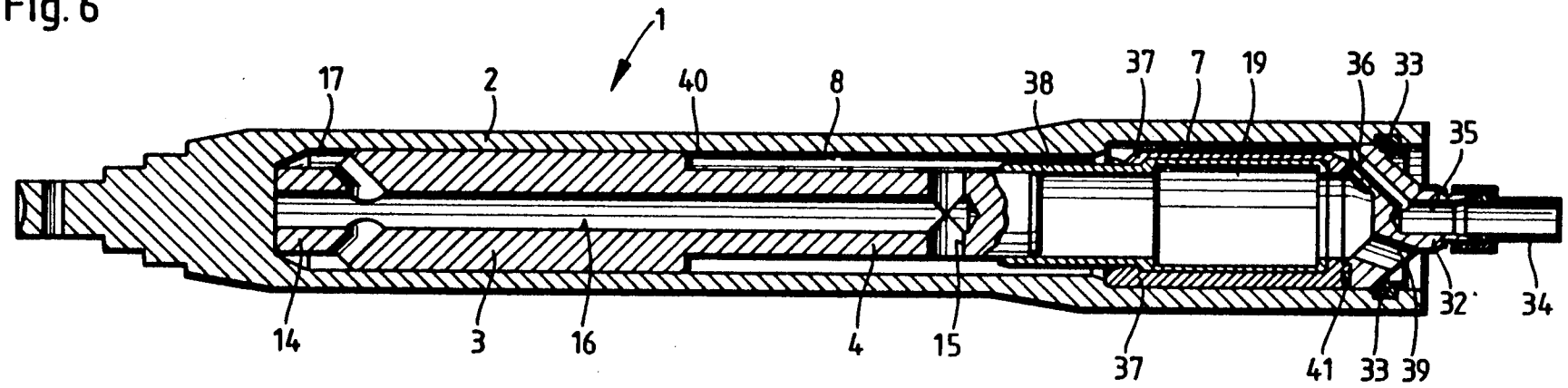
FIG. 6 shows a percussion machine according to the invention with a distributor cap for the pressure medium arranged on the rear housing end in the machine housing.

The ram boring machine 1 shown with the percussion piston 3 in its front end position in FIG. 6 is provided at its rear end with a distributor cap 32 that is built into the housing 2 by means of annular segments 33 and fastened there by a rotation-locking means 41. It has a central blind bore 35, connected to a supply hose 34, that communicates with a radial externally arranged distributor bore 36 that extends forwards obliquely and opens into the flow passage 7 that leads into the cylinder chamber 8 located behind the percussion piston 3. The flow passage 7 is bounded by the inner wall of the housing 2 and an elastic block 37 that accommodates a control bush 38. The distributor cap 32 is also provided with a discharge bore 39 via which the compressed air flowing backwards in the arrowed direction 18, upon the backward movement of the percussion piston 3, can escape. This is the case when, with the backward movement of the percussion piston 3 into its rear end position (not shown in FIG. 6), the front end of the piston rod 4 with the transverse bore 15 enters into the annular chamber 19 in the control bush 38. There is then an unobstructed connection between the axial passage 16 of the piston rod 4, which passage leads the discharge air rearwardly, and the discharge bore 39. The distributor cap 32 guides the centrally inflowing pressure medium outwards into the eccentrically arranged flow passage 7. With a closed construction of the machine and central supply of pressure medium it nevertheless ensures eccentric distribution of the pressure medium so that to advance the piston the large annular surface 40 of the percussion piston 3 is always acted on.

What is claimed is:

1. A percussion machine, comprising:

a housing which further comprises rear transverse wall means;

a percussion piston which is axially displaceable in said housing between front and rear end positions and which has a front end face which is remote from said wall means and a rear end face which faces said wall means and which defines therewith a cylinder chamber; and means for connecting said cylinder chamber with a pressure source;

wherein said wall means comprises, on a side thereof and remote from said cylinder chamber, an outlet annular chamber;

and further wherein said percussion piston has a piston rod projecting from said rear end face thereof and into said wall means and having and end region remote from said rear end face, and an axial channel extending from said front end face up to said end region of said piston rod and closed thereat;

and further wherein said piston rod has, in said end region thereof, a transverse bore which communicates with said axial channel, wherein said transverse bore is arranged in said end region of said piston rod with respect to said wall means in such a manner that it communicates, in the front end position of said percussion piston, with said cylinder chamber, and communicates, in the rear end position of said percussion piston, with said outlet annular chamber in said wall means.

2. The percussion machine of claim 1, wherein said wall means includes a control bush for guiding said piston rod.

3. The percussion machine of claim 2, which further comprises a means for axially displacing said control bush.

4. The percussion machine of claim 3, wherein said axially displacing means comprises a thread means.

5. The percussion machine of claim 1, wherein said wall means further comprises:

a distributor cap which is arranged at a rear end thereof, wherein said distributor cap has a blind bore;

at least one distributor bore which communicates with said blind bore; and a discharge bore, and further wherein said percussion machine further comprises a flow passage for communicating said distributor bore with said cylinder chamber.

6. The percussion machine of claim 5, which further comprises a means for non-rotatably securing said distributor cap to said housing.

7. The percussion machine of claim 5, which further comprises:

an elastic block which is arranged in said housing; and a control bush which is supported in said elastic block for slidingly receiving said piston rod.

8. The percussion machine of claim 7, which further comprises a means for axially displacing said control bush.

9. The percussion machine of claim 1, wherein said piston has, in said end region thereof, a bore into which said axial channel opens, and further wherein said percussion machine comprises an insert which is received in said bore for closing said axial channel.

10. The percussion machine of claim 9, wherein said insert has a hollow cylindrical control head and a transverse bore formed therein.

11. The percussion machine of claim 9, which further comprises a thread means for securing said insert in said end region of said piston rod.

12. The percussion machine of claim 9, which further comprises a means for axially displacing said insert.

13. The percussion machine of claim 1, wherein said percussion machine is a self-propelled ram boring machine.

* * * * *